United States Patent [19]

Markowski et al.

[11] 4,389,848

[45] Jun. 28, 1983

[54] BURNER CONSTRUCTION FOR GAS TURBINES

[75] Inventors: Stanley J. Markowski, East Hartford; Ronald A. Jeroszko, Hebron; Robert P. Lohmann, South Windsor, all of Conn.

[73] Assignee: United Technologies Corporation, Hartford, Conn.

[21] Appl. No.: 224,408

[22] Filed: Jan. 12, 1981

[51] Int. Cl.[3] ..... F02C 7/22

[52] U.S. Cl. ..... 60/738; 60/746; 60/750; 431/352

[58] Field of Search ..... 431/352, 187, 171; 60/738, 746, 749, 750

[56] References Cited

U.S. PATENT DOCUMENTS

| | | | |
|---|---|---|---|
| 2,999,359 | 9/1961 | Murray | 60/749 |
| 3,430,443 | 3/1969 | Richardson | 60/738 |
| 3,754,393 | 8/1973 | Handa | 60/750 |
| 3,788,065 | 1/1974 | Markowski | 60/749 |
| 3,906,718 | 9/1975 | Wood | 60/738 |
| 3,961,475 | 6/1976 | Wood | 60/738 |
| 4,045,956 | 9/1977 | Markowski | 60/746 |
| 4,054,028 | 10/1977 | Kawaguchi | 60/749 |
| 4,173,118 | 11/1979 | Kawaguchi | 431/352 |
| 4,199,935 | 4/1980 | Hakluytt | 431/352 |
| 4,237,694 | 12/1980 | Wood | 60/746 |

*Primary Examiner*—Daniel J. O'Connor
*Attorney, Agent, or Firm*—Charles A. Warren

[57] ABSTRACT

A burner construction for low emission burners in which the primary fuel is injected with air in an annulus into the upstream end of the burners so as to cause a significant recirculation of the fuel and air mixture adjacent to the end cap, the secondary fuel is injected into the burner in a small angle spray at a point substantially spaced from the end cap and large combustion and/or dilution holes in the burner wall a small distance upstream of the secondary nozzle are sized to produce an additional recirculation in the primary fuel and air around the secondary nozzle with this additional recirculation in the direction opposite to the first recirculation.

8 Claims, 2 Drawing Figures

BURNER CONSTRUCTION FOR GAS TURBINES

BACKGROUND OF THE INVENTION

With the advent of a recognized need to minimize undesirable emissions in the power plant at both low and high power operation much attention had been given to burner designs which will assure combustion temperatures within the burner so as to produce a minimum of CO, NOx and unburned hydrocarbons in the exhaust at all power settings with a minimum of power loss. The worst problem is the unburned hydrocarbons and CO at idle and low powers.

Attempts at improving the combustion have inevitably resulted in more complex burner constructions particularly the multiple stage combustors in which combustion occurs in several discrete zones. These concepts generally lead to complex fuel injection systems at several locations in the burner. It is desirable to produce the desired mixing and circulation of the combustible mixtures within the burner with a minimum of extraneous elements within the burner structure and to produce the recirculation desired without mechanical obstruction to the flow of the combustible mixture within the burner.

SUMMARY OF THE INVENTION

One burner construction producing significantly low emissions at all power settings is described in the copending application of Lohmann et al Ser. No. 968,652 filed Dec. 11, 1978, the inventors above-named being two of the inventors of the present application. The present application is essentially an improvement on this earlier application in that the recirculation of the combustion gases is significantly improved in the primary zone to assure low objectionable emissions at all power angle settings and particularly at idle. The present application produces a second recirculation zone downstream of the recirculation zone described in the above pending application.

A feature of the present invention, therefore, is a device for producing two recirculation zones, one immediately downstream of the end cap to cause a significant part of the mixture of primary fuel and air to recirculate forwardly radially outward from the primary nozzle and inwardly over the inner surface of the cap and another recirculation zone downstream of the first in which the direction of the recirculation in this second zone is opposite to the direction in the first recirculation zone. A further feature of the invention is a row of combustion and/or dilution holes in the burner wall in a position to cause this second recirculation. Another feature is the location of these combustion and/or dilution holes at a point upstream of the secondary fuel nozzle, the discharge end of which is located midway of the burner in a radial direction and at a point a significant distance downstream from the end cap. Another feature is a trip or flange on the secondary nozzle in a position to improve the recirculation in both zones.

According to the invention the burner has an inlet end cap with a centrally located secondary nozzle extending downstream a significant distance within the burner and with an annular primary fuel nozzle surrounding the secondary nozzle and discharging a mixture of fuel and air in a substantially flat, conical configuration spaced enough from the end cap to cause and permit a recirculation of a significant part of the mixture forwardly of the burner and radially inward over the inner surface of the end cap. The secondary nozzle has a trip thereon in the form of a flanged ring at a point about halfway the length of the nozzle and this trip cooperates with large dilution holes in the burner wall slightly upstream of the end of the secondary nozzle to cause a secondary recirculation of most of the remainder of the primary fuel and air mixture, this recirculation being in a direction opposite to the first recirculation and located around the inner end of the secondary nozzle downstream of the trip.

The foregoing and other objects, features and advantages of the present invention will become more apparent in the light of the following detailed description of preferred embodiments thereof.

DETAILED DESCRIPTION OF THE PREFERRED EMBODIMENT

The invention is adapted for use in a burner so constructed as to have a primary combustion zone generally near the upstream end of the burner and a secondary combustion zone downstream of the primary zone. Generally air for combustion in the primary zone is supplied through the primary nozzle and is mixed with the fuel discharged from the primary nozzle this air being introduced in a swirl in order to create the conical discharge of the primary fuel. Although the construction shown and described is adapted for use in conventional annular burners or can-type burners it is also adapted for the more recently developed high performance burners in which there is a throat section between the primary and secondary zone. The invention will be described as applied to this high performance burner, one example of which is shown in the Markowski et al Pat. No. 3,973,395.

Figure 1:
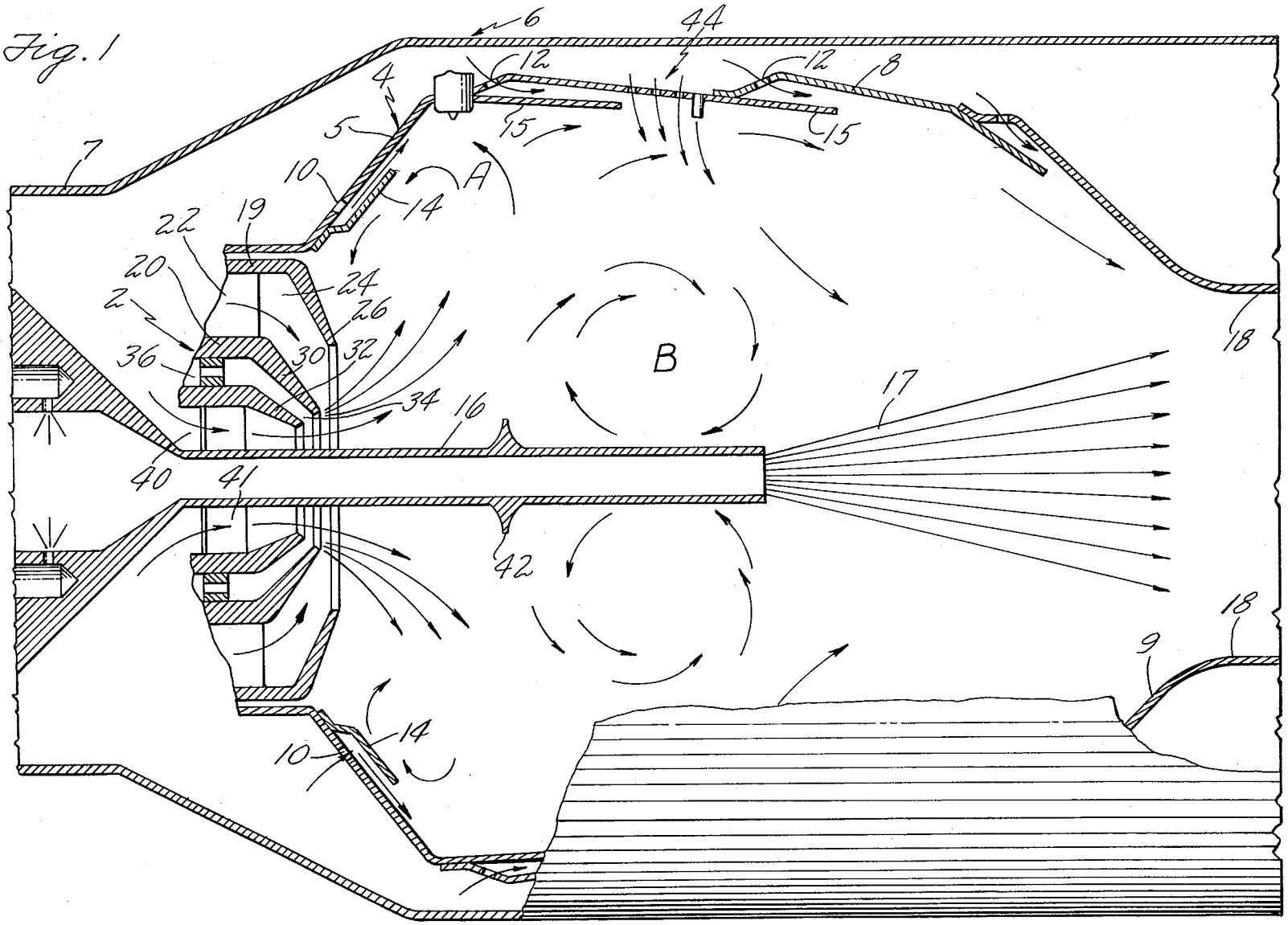
FIG. 1 is a longitudinal sectional view through a burner incorporating the invention.
Figure 2:
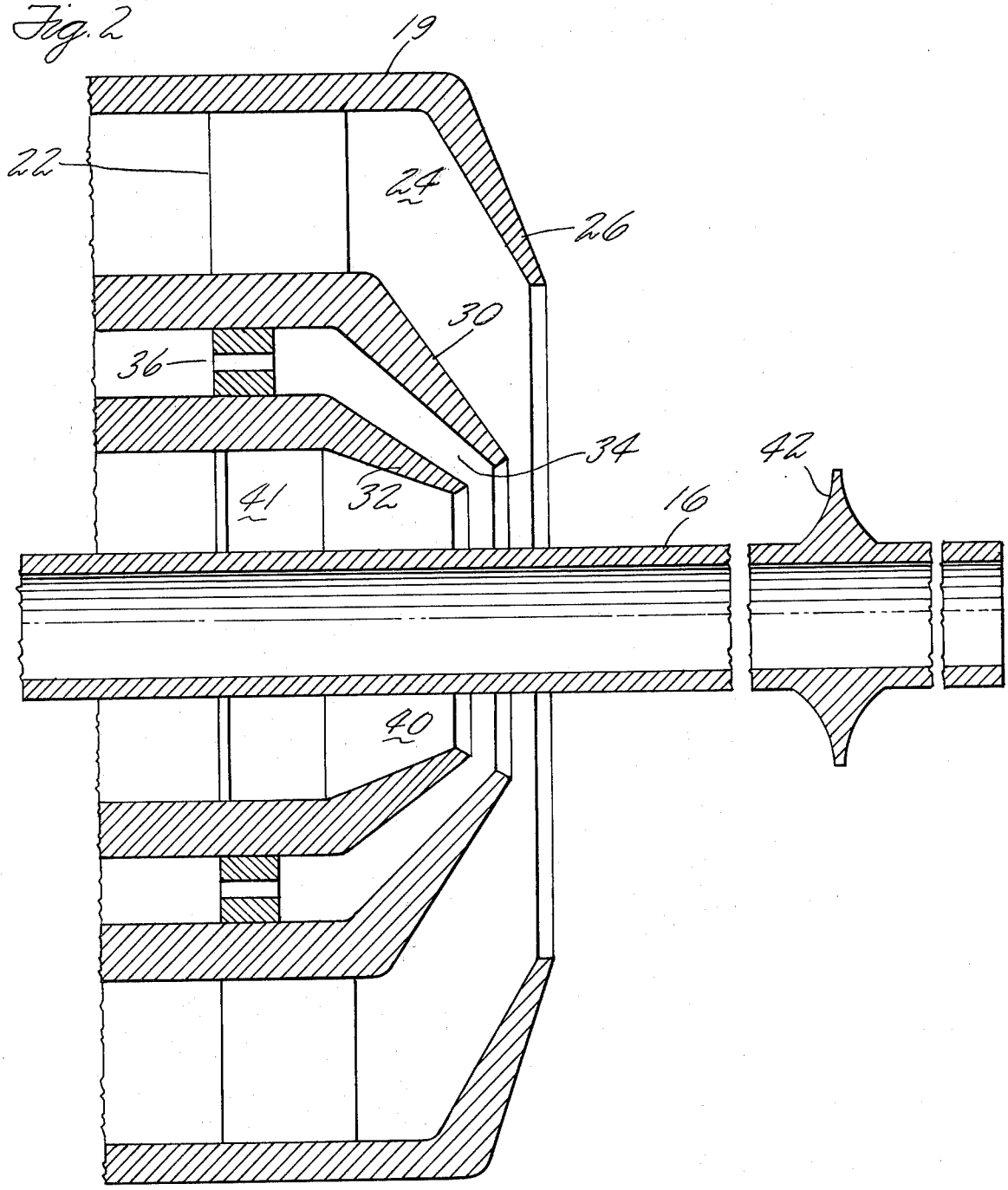
FIG. 2 is an enlarged view of the primary nozzle.

Referring first to FIG. 1 the fuel injector 2 is shown as applied to a burner 4 having an upstream end cap 5 in which the injector is positioned. This burner is located within a combustion chamber duct 6. This duct 6 has an inlet end 7 which receives air under pressure, as from a gas compressor, and, from this inlet end, the duct diverges to form a diffuser so that the air pressure is increased at and downstream of the end cap 5.

The end cap 5 and the opposite sidewalls 8 and 9 adjacent thereto forming the burner have openings 10 and 12 therein which are shielded on the inside by rings 14 and 15 that guide the air entering through these holes along the wall surface of the burner for the purpose of film cooling. A relatively small amount of air enters the burner through these holes and is essentially only for cooling purposes and provides no significant combustion air. Primary air for combustion essentially enters the burner with the fuel through the primary nozzle although additional combustion and/or dilution air enters through larger holes in the sidewalls as will be described. Centrally of the end cap is the secondary fuel nozzle 16 which extends downstream from the cap a significant distance and discharges a mixture of fuel and air from the downstream end thereof in a relatively narrow spray 17 so that this secondary mixture reaches the secondary combustion zone before any significant combustion occurs.

The downstream end of the primary zone is defined by a throat 18 defined by the converging inner and outer walls 8 and 9 of the burner at this point. The secondary zone of the burner is downstream of the throat where the sidewalls 8 and 9 again diverge and this zone is arranged for the secondary combustion to occur therein. It will be noted that as shown the secondary mixture of fuel and air is at such a spray angle that the spray substantially fills the throat with very little of the fuel and air mixture impinging on the converging walls of the burner.

The primary fuel nozzle is arranged to mix primary fuel with swirling air for discharge into the burner. The upper end of the burner receives a sleeve 19 spaced from a housing 20 by air swirler vanes 22 defining a passage 24. The swirling air in this passage 24 is directed inwardly toward the nozzle axis as it leaves the vanes by an inturned lower edge 26 on the sleeve 19. The housing 20 has two concentric conical flanges 30 and 32 defining between them a discharge nozzle 34 for fuel from a supply chamber 36. Radially inward of the inner flange 32 is the secondary nozzle 16 defining another annular air path 40 with swirl vanes 41 therein and from which swirling air at the discharge end is also directed inwardly by the shape of the flange 32. The fuel stream between the flanges 30 and 32 is also directed inwardly by the conical flanges to mix with air flowing from path 40. As the fuel mixes with and is atomized by air from path 40 it is picked up by the swirling air from passage 24 and is caused by the centrifugal force resulting from the swirl to flow outwardly away from the axis of the nozzle forming a toroidal recirculation of air and fuel in the upper end of the primary zone with burning taking place here in what may be referred to as zone A or the primary recirculation zone.

The secondary nozzle has a trip 42 thereon about halfway the length of the nozzle within the burner and this trip serves in cooperation with a row of combustion/dilution holes 44 in the burner walls to cause a second recirculation of the fuel and air mixture at a point downstream of the first recirculation and also forwardly or upstream of the discharge end of the secondary nozzle. By properly locating the position and by suitable dimension of the trip 42 and also by controlling the dimension of the dilution holes it is possible to have the secondary recirculation zone, zone B, occur at a point generally radially inward of the first recirculation and with the fuel and air mixture in this zone recirculating in the direction opposite to that in zone A. With a significant number of combustion/dilution holes in the burner walls the fuel and air mixture is substantially picked up by the combustion/dilution air and caused to recirculate in the secondary recirculation zone. A part of the air and fuel mixture from the primary nozzle does pass, as shown by the arrows in the figure, between the jets of air from the dilution holes and this unrecirculated primary fuel and air continues on downstream and ultimately enters the throat of the nozzle of the burner to mix with the secondary fuel and air.

It will be understood that variation in the position of the combustion/dilution holes with respect to the end of the secondary nozzle and with respect to the location of the trip on the secondary nozzle will permit an increase or decrease in the proportion of primary fuel and air that is recirculated in zone B and also the proportion of primary fuel and air that passes the combustion/dilution air and continues on downstream. In this way it is possible to control to a significant degree the proportion of primary fuel and air that recirculates in zone A with respect to the proportion that is recirculated in zone B thereby controlling as necessary the completeness of the vaporization and combustion and thus the temperature to which the fuel and air mixture is raised on each of zones A and B. The effect of the secondary combustion downstream of the throat of the burner is not a part of this invention as it is described in the copending application above referred to.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A burner construction including:

an inlet end cap;

a central secondary fuel and air nozzle in said end cap having a discharge end spaced from the end cap and located within the burner;

an annular primary fuel nozzle surrounding said secondary fuel nozzle, said primary nozzle including swirling air discharge means for mixing with the fuel and causing the mixture to be discharged in a wideangled spray;

sidewalls extending downstream from the edges of the end cap said walls converging at a point spaced from the end cap to form a throat in the burner at a point downstream of the discharge end of the secondary nozzle;

said sidewalls having a row of relatively large holes therein at a point between the end cap and the throat and upstream of the discharge end of the secondary nozzle for introducing air substantially radially of the burner and substantially to the secondary nozzle; and a trip on and surrounding the secondary nozzle at a point upstream of said row of holes, said trip serving to enhance the outward movement of the mixture of primary fuel and air with the combustion/dilution air to improve the recirculation adjacent the end cap and to enhance recirculation of the dilution air that is directed in an upstream direction as it impinges on the tube.

2. A burner construction as in claim 1 in which the angle of the discharge of the primary fuel and air is such as to create a recirculation of part of this mixture adjacent the end cap.

3. A burner construction as in claim 1 in which the end cap is essentially imperforate except for the nozzles therein.

4. A burner construction as in claim 1 in which the end of the secondary fuel nozzle and the angle of the spray of the secondary fuel and air mixture discharged therefrom substantially fills the throat.

5. A burner construction as in claim 1 in which the dilution holes are a short distance upstream from the end of the secondary nozzles and at such an angle as to cause impingement of substantially all of the air entering the combustion/dilution holes against the secondary nozzle adjacent to the discharge end.

6. A burner construction including:

an inlet end cap;

a central secondary fuel and air nozzle in said end cap having a discharge end spaced from the end cap and located within the burner;

an annular primary fuel nozzle surrounding said secondary fuel nozzle, said primary nozzle including swirling discharge means for mixing with the fuel and causing the mixture to be discharged in a wide angled spray;

sidewalls extending downstream from the edges of the end cap;

said sidewalls having a row of relatively large holes therein at a point and upstream of the discharge end of the secondary nozzle for introducing combustion/dilution air substantially radially of the burner and substantially to the secondary nozzle; and a trip on and surrounding the secondary nozzle at a point upstream of said row of holes, said trip serving to enhance the outward movement of the mixture of primary fuel and air with the dilution air to improve the recirculation adjacent the end cap and to enhance recirculation of the dilution air that is directed in an upstream direction as it impinges on the tube.

7. A burner construction as in claim 6 in which the angle of the discharge of the primary fuel and air is such as to create a recirculation of part of this mixture adjacent the end cap.

8. A burner construction as in claim 6 in which the end cap is essentially imperforate except for the nozzles therein.

* * * * *